US006727649B1

(12) United States Patent
Yano et al.

(10) Patent No.: US 6,727,649 B1
(45) Date of Patent: Apr. 27, 2004

(54) FLUORESCENT LAMP, DISCHARGE LAMP AND LIQUID CRYSTAL BACKLIGHT DEVICE INCORPORATING THIS

(75) Inventors: Hidetoshi Yano, Ehime (JP); Takanobu Ueno, Ehime (JP)

(73) Assignee: Harison Toshiba Lighting Corporation, Ehime (JP)

( * ) Notice: Subject to any disclaimer, the term of this patent is extended or adjusted under 35 U.S.C. 154(b) by 12 days.

(21) Appl. No.: 09/869,896

(22) PCT Filed: Nov. 9, 2000

(86) PCT No.: PCT/JP00/07990

§ 371 (c)(1),
(2), (4) Date: Oct. 5, 2001

(87) PCT Pub. No.: WO01/35445

PCT Pub. Date: May 17, 2001

(30) Foreign Application Priority Data

Nov. 10, 1999 (JP) ..... 11-319986
Jul. 28, 2000 (JP) ..... 2000-233193

(51) Int. Cl.[7] ..... H01J 61/04
(52) U.S. Cl. ..... 313/607; 313/234; 313/594
(58) Field of Search ..... 313/607, 594, 313/234

(56) References Cited

U.S. PATENT DOCUMENTS 5,747,946 A * 5/1998 Tyler ..... 313/607
5,965,093 A * 10/1999 Adams ..... 422/186.04

FOREIGN PATENT DOCUMENTS

| | | |
|---|---|---|
| JP | 5-174792 | 7/1993 |
| JP | 4203345 | 8/1993 |
| JP | 10-112290 | 4/1998 |
| JP | 10-284008 | 10/1998 |

OTHER PUBLICATIONS

CRC Handbook of Chemistry and Physics, 76$^{th}$ edition 1995–6, Table of Thermal Properties of Commercial Metals and Alloys.*

* cited by examiner

*Primary Examiner*—Ashok Patel
*Assistant Examiner*—Sharlene Leurig
(74) *Attorney, Agent, or Firm*—Banner & Witcoff, Ltd.

(57) ABSTRACT

A fluorescent lamp of this invention has a phosphor film formed on the inner wall surface and a discharge medium containing xenon-gas filled in the glass tube having the sealing portions at both ends. In this one end in the glass tube, an inner electrode is arranged and a first feeding lead wire connected to this inner electrode is connected to one of the sealing portion by penetrating airtight. On the outer surface of the glass tube, an outer electrode composed of a conductor spirally wound round it along the axial direction of the tube. At the other end of the glass tube, a second feeding lead wire is buried in the sealing portion and the other end is lead out of the glass tube. The end of this outer electrode is electrically connected to the second feeding lead wire and mechanically fixed there. Further, the outer surface of the outer electrode including the glass tube is covered with a translucent resin film layer and thereby, fixing the outer electrode to the outer surface of the glass tube in one united body.

18 Claims, 6 Drawing Sheets

FLUORESCENT LAMP, DISCHARGE LAMP AND LIQUID CRYSTAL BACKLIGHT DEVICE INCORPORATING THIS

This is a U.S. National Phase Application Under 37 CFR 1.371 and applicants herewith claim the benefit of priority of PCT/JP00/07990 filed Nov. 9, 2000, in the Japanese Patent Office, Patent Application No.11-319986 filed in Japan on Nov. 10, 1999 and Patent Application No. 2000-233193 filed in Japan on Jul. 28, 2000, each of whose contents are incorporated by reference.

TECHNICAL FIELD OF THE INVENTION

This invention relates to a fluorescent lamp and a discharge lamp and more particularly to a fluorescent lamp that is suited for a light source for the backlighting liquid crystal displays that are used in various electronic devices such as personal computers, car-navigation displays, etc.

BACKGROUND OF THE INVENTION

A fluorescent lamp is used as a light source for the backlighting of liquid crystal displays to irradiate uniform light to liquid crystal panels from the back in liquid crystal displays that are used in, for instance, personal computers or car-navigation displays. Accompanied with demands for large-sized, thin and high performance display area of liquid crystal displays, stable and sufficient light intensity, uniform distribution of luminance in the axial direction of lamp tube in the wide temperature range from −40° C. to 85° or under the control of light intensity from several % to 100%, are demanded for a fluorescent lamp itself as a light source for the backlighting jointly for small-sized luminance tube diameter and extended tube length.

However, because the light intensity of the conventional fluorescent lamp which contains mercury as discharge gas is insufficient at a low ambient temperature and mercury may cause the environmental pollution, the development of a fluorescent lamp without using mercury gas is demanded.

A small discharge lamp or a fluorescent lamp using inert gas such as neon gas, krypton gas or xenon gas is disclosed in Japanese Laid-Open Patent Publication (Kokai) No.57-63756. In this discharge lamp, one of two electrodes is provided in a glass tube and the other electrode is provided outside the glass tube. One of the electrodes is provided which extends along an almost entire length of a glass tube and the other electrode is provided on the outer surface of the glass tube against the electrode provided in the glass tube. It was disclosed that this lamp is a small discharge lamp with diameter of 2~10 mm and 50~200 mm long, which is used as a luminous display for displaying characters, numerals or symbols, in which a single lamp or plurarity of lamps having a straight or curved tube is or are used. It is also disclosed that such lamps are used as an energy-saving pilot lamp or a beacon light.

However, for the conventional discharge lamp or the fluorescent lamp in this structure, it is difficult to keep a uniform discharge distance from the inner electrode to the outer electrode along the overall length of the inner electrode and as a result, such problems are caused that a partial discharge is produced and a stable positive column cannot be formed on the entire length of a glass tube. In other words, since a slender fluorescent lamp using a glass tube of 1.6~10 mm in outer diameter and 100~500 mm in length, for example, is used for a backlighting source of a liquid crystal display, it is extremely difficult, in view of the manufacturing technology, to provide electrodes having a uniform discharge distance along the entire length of the glass tube.

Further, in a liquid crystal display, a fluorescent lamp is often subject to influence of vibration depending on the using condition and the inner electrode is deformed locally. Therefore, it is difficult to maintain a discharge distance at always constant value.

Furthermore, glass tubes having complicated shapes such as W or U-shaped tube may be often used for the backlighting sources in the liquid crystal displays. However, it is extremely difficult for the glass tube having such structure to form the electrodes having a uniform discharge distance between the inner electrode and the outer electrode along the entire length of them.

Further, even if a glow discharge region is formed along the entire length of the discharge lamp or the fluorescent lamp having the structure described above, there was a problem that electrons are actively emitted around an inner electrode and thus a diffused positive column is hardly formed thereby resulting a phenomenon that generation of ultraviolet rays is suppressed, in particular when a discharge medium containing xenon is used as discharge gas. Accordingly, when this type of the electrode structure is used for a fluorescent lamp having a glass tube inner wall of which is coated with phosphor for generatining luminance excited by ultraviolet rays, sufficient brightness cannot be obtained.

For the purpose of solving such problems involved in the conventional fluorescent lamps as described above, the applicant of the present invention filed an application as PCT/JP00/06491 (International Filing Date: Sep. 22, 2000) for a fluorescent lamp comprising a glass tube both ends of which are sealed airtight and filled with a discharge medium; a phosphor layer formed on an inner surface of the glass tube; an inner electrode arranged at one end of the glass tube and being given a electric potential; and an outer electrode composed of a conductor spirally wound round the glass tube between the both ends along an axis the tube at a prescribed pitch and being given with another electric potential.

It is an object of the present invention to provide a discharge lamp or a fluorescent lamp which are capable of stably emitting sufficient bright light for the entire length of a glass tube composing the discharge lamp by further improving the invention described above.

It is a further object to provide a discharge lamp or a fluorescent lamp capable of stably emitting light in an uniform luminance distribution for the overall length of a glass tube composing the discharge lamp or the fluorescent lamp.

SUMMARY OF THE INVENTION

A fluorescent lamp according to the present invention comprises a glass tube having both ends sealed airtight and containing a discharge medium filled therein, a fluorescent layer formed on the inner wall of the glass tube, an inner electrode arranged at one end of the glass tube which is given with one electric potential, and an outer electrode composed of a linear conductor spirally wound around the glass tube between its both ends at a prescribed pitch along an axis of the tube and is given with another electric potential, the outer electrode is so designed as to satisfy the formula:

$$w \times n \leqq 0.3$$

where w(cm) is a width of the conductor comprising the outer electrode and n(turns/cm) is the average number of turns of the conductor in the unit length in the axial direction of the glass tube.

Further, a fluorescent lamp according to the present invention comprises a glass tube with a phosphor film formed on the inner surface thereof and with sealing portions so formed at each end thereof that a discharge medium is filled therein, a first feeding lead wire penetrating one of the sealing portions of the glass tube airtight, an inner electrode connected to an end of the feeding lead wire extending into the glass tube, a second feeding lead wire composed of a linear conductor which is spirally wound around an outer surface of the glass tube along an axial direction of the glass tube and an end of which is electrically connected to the second feeding lead wire, wherein the outer electrode is so designed that a winding pitch of the linear conductor becomes continuously or step wisely small corresponding to a distance from the inner electrode in the axial direction of the glass tube.

Further, a fluorescent lamp according to the present invention comprises a translucent tube with sealing portions formed at its both ends, a phosphor film formed on an inner surface of the translucent tube, a discharge medium containing rare gas filled in the translucent tube, a first feeding lead wire penetrating one of the sealing portions of the translucent tube and sealed therein airtight, an inner electrode provided at an end of the first feeding lead wire, and an outer electrode composed of a linear conductor which is spirally wound around the translucent tube for almost entire length of the tube in its axial direction and an end of which is connected to the second feeding lead wire, wherein the outer electrode is provided with a tube power increasing means at a portion where a disturbed diffused positive column or a constricted positive column is generated in the translucent tube when the fluorescent lamp is operated.

Further, in the fluorescent lamp according to the present invention, a winding pitch of the spirally wound linear conductor at the tube power increasing means is smaller than the winding pitch at the portion facing an adjacent diffused positive column.

Further, the fluorescent lamp according to the present invention comprises a long and slender translucent airtight container, a phosphor film formed on an inner surface of the translucent container, an inner electrode provided in the translucent airtight container, a discharging medium primarily composed of rare gas filled in the translucent airtight container, and an outer electrode composed of a conductive coil which is substantially in contact with an outer surface of the translucent airtight container extending along its longitudinal direction apart from the inner electrode and which enables to generate discharge in the translucent container between the outer electrode and the inner electrode, wherein the outer electrode containes at least one point of inflection where the winding pitch of the coil change from a small value to a large value.

Further, a fluorescent lamp according to the present invention comprises along and slender translucent air tight container, a phosphor film formed on the inner surface of the translucent container, a pair of inner electrodes sealed in the translucent container at both ends, a discharge medium primarily composed of rare gas filled in the translucent airtight container, and an outer electrode formed with a linear conductor coil which is wound around the outer surface of the translucent airtight container along a longitudinal direction of the translucent airtight container at a prescribed pitch and which generates the discharge between the outer electrode and the pair of inner electrodes, wherein a winding pitch of the outer electrode becomes minimum in a region pH facing a pair of constricted positive columns PCs generated in the translucent airtight container when the fluorescent lamp is in operation, becomes maximum at both ends in a region pV facing a diffused positive column PCd generated in the translucent airtight container, and decreases step wisely from the both ends toward the central portion.

Further, a discharge lamp according to the present invention comprises a translucent tube having sealing portions formed at its both ends and being filled with a discharge medium, an inner electrode which is arranged at one end of the translucent tube and is given with an electric potential, and an outer electrode which is composed of a linear conductor which is spirally wound around the translucent tube between the both ends along an axis of the translucent tube at a prescribed pitch and is given with another potential, wherein the outer electrode is so designed as to satisfy the formula:

$$w \times n \leqq 0.3$$

where w(cm) is the width of the linear conductor forming the outer electrode and n(times/cm) is the average number of turns of windings per unit length in the axial direction of the translucent tube.

Further, a discharge lamp according to the present invention comprises a long and slender translucent tube having sealing portions formed at both ends so as to fill with a discharge medium within the translucent tube, a first feeding lead wire penetrating airtight one of the sealing portions of the translucent tube, an inner electrode connected to the end of the feeding lead wire at a portion extended into the translucent tube, and an outer electrode composed of a linear conductor which is spirally wound around the outer surface of the glass tube in the axial direction of the tube and an end of which is electrically connected to a second feeding lead wire, wherein the outer electrode is so designed that a winding pitch of the linear conductor becomes small continuously or stepweisely in an axial direction of the translucent tube corresponding to a distance from the inner electrode.

Further, a discharge lamp according to the present invention comprises a translucent tube having sealing portions formed at its both ends, a discharge medium including rare gas filled in the translucent tube, a first feeding lead wire sealed penetrating airtight one of the sealing portions of the translucent tube, an inner electrode provided at an end of the first feeding lead wire, and an outer electrode composed of a linear conductor which is spirally wound around the translucent tube for almost entire length in an axial direction of the tube and an end of which is connected to a second feeding lead wire, wherein the outer electrode is provided with a tube power increasing means a ta portion facing a disturbed diffused positive column or a constricted positive column generated in the translucent tube when the discharge lamp is in operation.

Further, a liquid crystal backlighting device according to the present invention comprises a main body of the liquid crystal backlighting, a fluorescent lamp arranged in the main body and a lighting circuit to operate the fluorescent lamp.

DETAILED DESCRIPTION OF THE PREFERRED EMBODIMENTS

Figure 1:
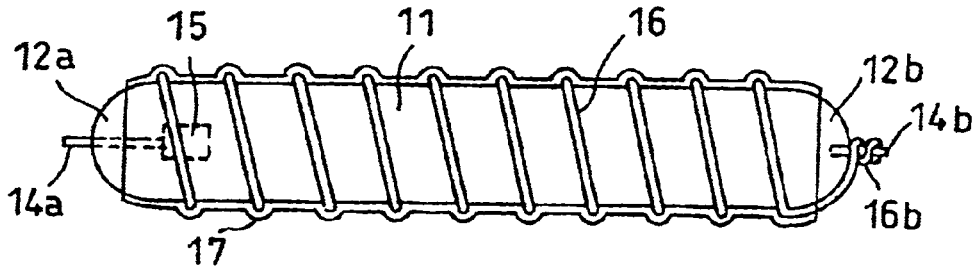
FIG. 1 is a side view of a fluorescent lamp showing a first embodiment according to the present invention.

Preferred embodiments according to the present invention will be described below in detail referring to the drawings.

Figure 2:
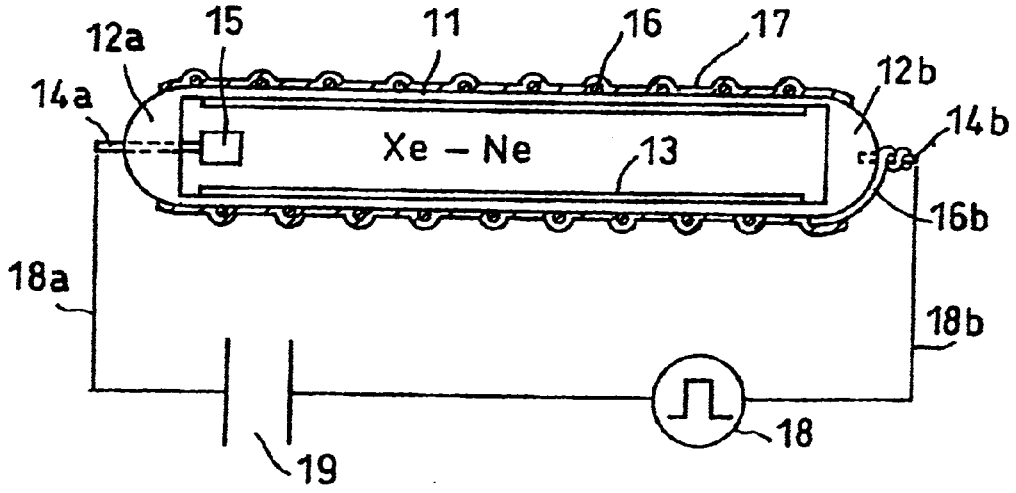
FIG. 2 is a diagram showing a vertical sectional view of the fluorescent lamp shown in FIG. 1 and showing a structure with a lighting circuit.

FIG. 1 is a side view showing a structure of a fluorescent lamp according to the present invention and FIG. 2 is a vertical sectional view showing the fluorescent lamp including a lighting circuit.

As shown in these diagrams, the fluorescent lamp according to the present invention has a glass tube 11 which functions as a luminous tube. The glass tube 11 are sealed airtight at both sides where sealing portions 12*a*, 12*b* are formed. A phosphor film 13 is formed on an inner surface of the glass tube 11.

Here, the glass tube 11 has an outer diameter of 1.6~10 mm and a length of 50~500 mm. An airtight inner space of the glass tube 11 is filled with a discharge medium, for example, such a rare gas as xenon gas or a mixed rare gas of xenon gas as a main component with other one or plurarity of rare gases.

A first feeding lead wire 14*a* is provided at the sealed portion 12*a* of the glass tube 11, wherein the wire 14*a* penetrates the portion into the inside the tube and is sealed airtight. A cylindrical inner electrode 15 is provided at an end of the lead wire that is extended to the inside of an airtight space. The inner electrode 15 has a cylindrical body of about 2.0 mm inner diameter and of about 4.0 mm long with a bottom provided at one end. The inner electrode 15 is made, for example, of an Ni plate. Further, in order to lower a tube voltage,it is possible to provide an electron emission material on an inner and outer surfaces of the inner electrode. The electron emission material referred to here is a material that is used for a cold cathode fluorescent lamp and is made of primarily, for example, alkaline earth metal of barium oxide and boric materials of rare earth elements such as boric lanthanum. However, the body of the inner electrode 15 may be formed in a column, flat or in a V-shape using Ni or Ni metal such as Ni alloy. When forming it in the cylindrical or in the column shape, it is desirable to form it in the structure of a truncated cone or a cone of which end surface diameter opposite to the discharge space is reduced. Further, the size of the inner electrode is generally designed to be 0.6~8.0 mm in the outside diameter and 2~10 mm in its length.

Next, the first feeding lead wire 14*a* is a linear or bar shaped wire made of kovar or tungsten having a diameter of about 0.4 mm. one end of the lead wire is connected to the cylindrical bottom surface of the inner electrode by welding or caulking and the other end is led out of the sealed portion 12*a* of the glass tube 11.

Further, on the outer surface of the glass tube 11, there is provided an outer electrode 16 made of a conductor of a Ni wire having a diameter of about 0.1 mm which is wouned spirally along the entire length in an axial direction (not shown) of the tube. This outer electrode 16 may be formed with an Ni or Cu wire of 0.05~0.5 mm in diameter.

The outer surface of the outer electrode 16 thus constructed is covered by a resin film layer 17 such as, for instance, a translucent heat shrinking tube which fixes the electrode so that the pitch of the electrode does not change in the axial direction. For the resin film layer 17, tubes or films made of heat shrinking polyethylene terephthalate resin, polyimide resin or fluorine contained resin having moderate heat resistance are desirable. Since the outer surface of the outer electrode 16 is covered and fixed with the heat shrinking resin film layer 17, its pitch can be kept always at a prescribed value, thereby uniform light being emitted along the axial direction of the tube and a high light output being obtained. That is, in the fluorescent lamp according to the present invention having a structure described above, the outer electrode 16 is wound spirally around the outer surface of the glass tube 11 at a prescribed pitch. This winding pitch affects the luminance distribution and the magnitude of a light output along the axial direction of the tube. Therefore, the outer surface of the glass tube wound with the outer electrode 16 is covered with the translucent resin film layer 17 so that the outer electrode 17 is insulated and protected, and that the spiral winding is closely fixed to the outer surface of the tube 11.

Next, the other sealing portion 12*b* of the glass tube 11 is provided with a second feeding lead wire 14*b*, one end of which is buried therein and the other end of which is led of the glass tube 11. This lead wire 14*b* should be kept away from contacting a discharge medium. The second feeding lead wire 14*b* is a wire rod made of, for instance, an Ni wire, a kovar wire or dumet wire having an outer diameter of 0.1~2.0 mm. It may be made of a ribbon shaped foil or a thin plate of Ni or Mo. The second feeding lead wire 14*b* can be buried in the sealing portion 12*b* in a method of making a bead stem by covering a surface of the second feeding lead wire 14*b* with a glass insulating layer, placing the stem in the end of the glass tube 11, and sealing the glass tube 11 by heating with a burner. It may be also buried by a method of inserting one end of the second feeding lead wire 14*b* into one end of the glass tube 11 before sealing and then, burying it by heating the end of the glass tube with a burner.

Around a portion of the second feeding lead wire 14*b* led to the outside of the glass tube 11, an end portion of the outer electrode 16 is wound for being connected and fixed to the lead wire 14*b* by an electric welding, soldering or caulking.

Next, a prescribed high frequency pulse voltage, for instance, having a frequency of 20~100 kHz and a pulse voltage of 1~6 kV is applied to the inner electrode 15 and the outer electrode 16 from a lighting power source 18 including an inverter via the first and second feeding lead wires 14*a,* 114*b,* power feed lines 18*a,* 18*b* and a capacitor 19, respectively. As a result, the discharge starts between the inner electrode 15 provided near the end of the glass tube 11 and the outer electrode 16 provided on the outer surface of the glass tube 11, wherein ultraviolet rays are radiated in the glass tube 11. The ultraviolet rays thus radiated excite a phosphor film 13 on the inner surface of the glass tube 11, and is converted into visible rays which are radiated to the outside of the glass tube 11. The glass tube 11, thus, functions as a fluorescent lamp. Here, the outer electrode 16 is normally grounded during the lighting operation,in order to reduce generation of a noise and a leak current to the outside of the tube.

Figure 3:
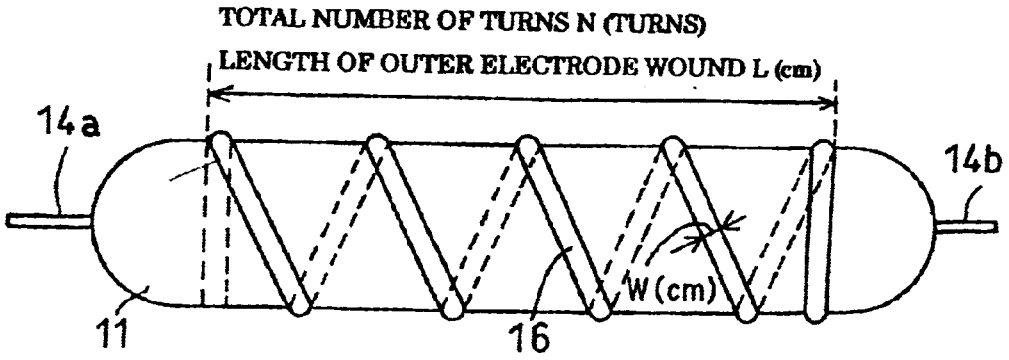
FIG. 3 is an enlarged side view of the fluorescent lamp shown in FIG. 1.

In the fluorescent lamp thus constructed, it was revealed that the operating state of the fluorescent lamp is affected by the structure of the outer electrode 16 as described below. That is, when the length of the outer electrode installed in the axial direction is L (cm), the width of the conductor is w (cm) and the number of average turns per unit length of the conductor in the axial direction of the glass tube is n as shown in FIG. 3, the value of w×n has a relationship with a minimum tube voltage Vrms at which the luminance of the fluorescent lamp spread over the whole region along the axial direction of the tube or a tube wall temperature T as shown in FIG. 4 and FIG. 5, respectively.

Here, the conductor width W is a width of a shadow of the conductor projected on the outer surface of the glass tube in parallel lights from the nominal direction of the contact plane to the outer surface of the glass tube at the portion where the conductor is wound. Further, the number of average turns n(times/cm) of the conductor can be calculated from a formula $$n=N/L$$

where N(times) is a total turns of the outer electrode and L(cm) is a length of the portion of the outer surface of the glass tube where the outer electrode is wound.

Figure 4:
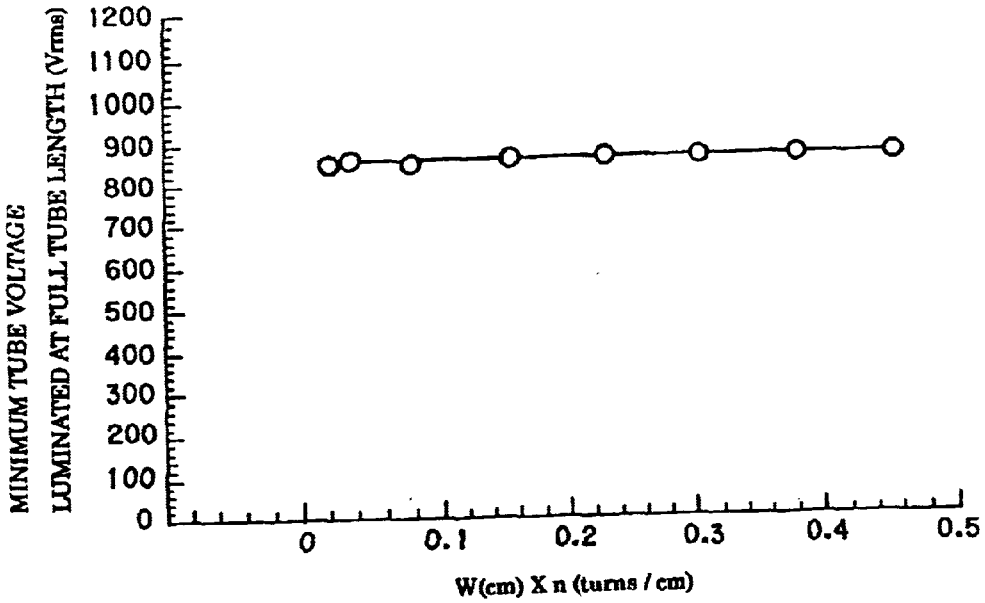
FIG. 4 is a graph showing a relation between a w×n value and a lowest tube voltage Vrms of an outer electrode 16 in the fluorescent lamp according to the present invention.
Figure 5:
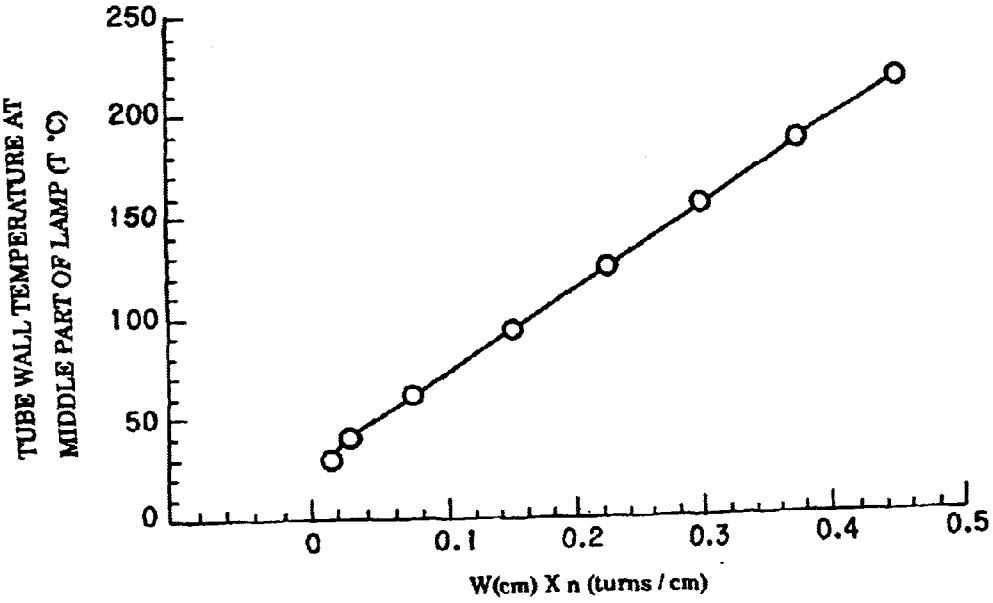
FIG. 5 is a graph showing a relation between a w×n value and a tube wall temperature T of an outer electrode in the fluorescent lamp according to the present invention.

Namely, y-axis in FIG. 4 shows the minimum tube voltage vrms required for emitting lights throughout a region (a discharge chamber) along the glass tube 11. The voltage Vrms has a constant value of about 900 Volts as seen from FIG. 4. The reason for requiring such relatively high value of the minimum tube voltage is considered to be reduced to the fact that a total electrostatic capacity between the outer electrode 16 and the inner surface of the glass tube 11 is relatively smaller than that of, for example, a plate shaped electrode due to the structure of the coil shaped outer electrode 16 and, thus, an impedance of the whole fluorescent lamp becomes high.

On the contrary, y-axis in PIG. 5 shows the tube wall temperature T° C. near the inner electrode 15 while the fluorescent lamp is turned on at the minimum tube voltage, which rises in proportion to the value of w×n. From FIG. 5, it is understood that the tube wall temperature T exceeds 150° C. when the value of wxn exceeds 0.3. The reason for the rise of the tube wall temperature is considered because the total electrostatic capacity between the outer electrode 16 and the inner wall surface of the glass tube 11 increases when a value of w×n increases and thus, the impedance of the whole fluorescent lamp becomes low. As a result, discharge current between the outer electrode 16 and the inner electrode 15 increases. Therefore, it is possible to control the temperature rise within a prescribed range by selecting the value of w×n to a prescribed value under such an use environment that the temperature rise becomes a special problem.

For example, when a fluorescent lamp is used as a power source of a backlight for a liquid crystal display, it is necessary to control the tube temperature so as not to exceed a heat resisting temperature (150° C.) of structural elements, especially a light conducting plate, used near the backlight. In FIG. 5, the value of w×n is 0.3 when the tube wall temperature T becomes 150° C. and it is therefore possible to execute stable discharge and luminance operation while maintaining the tube wall temperature constantly below 150° C. with the design of the lamp satisfying the formula of $w\times n \leqq 0.3$.

Further, since the lower limit value of the w×n is 0.01 according to the graph shown in FIG. 5, it is therefore desirable to keep the value of w×n within a range of 0.01~0.3.

Thus, it was confirmed that rise of the tube wall temperature can be suppressed and that stable lighting and a uniform luminance distribution are easily secured even when a relatively high voltage is applied between the outer electrode 16 and the inner electrodes 15, such voltage being required for the luminance in all area along the axial direction of the glass tube.

Figure 6:
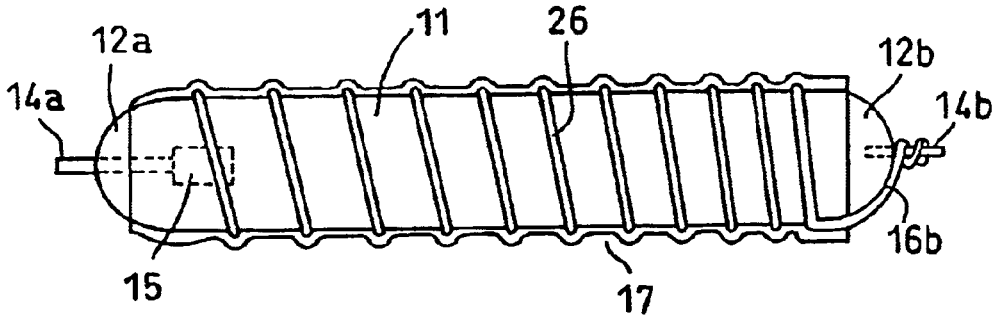
FIG. 6 is a vertical sectional view showing the fluorescent lamp in a second embodiment according to the present invention.

FIG. 6 is a side view of a fluorescent lamp showing a second embodiment of the present invention. In FIG. 6, the same or similar component elements as those of the fluorescent lamp shown in FIG. 1 are assigned with the same reference numerals for avoiding a duplicated explanation, and different portions will be explained below.

In the fluorescent lamp according to the embodiment, the winding pitch of an outer electrode 26 changes along the axis of the glass tube. That is, the winding pitch of the outer electrode 26 is narrowed successively according to a distance along the tube axis from the inner electrode 15. It is confirmed that the distribution of luminance intensity in the axial direction of the tube while a luminance lamp is turned on becomes nearly uniform with the outer electrode 26 described above.

Figure 7:
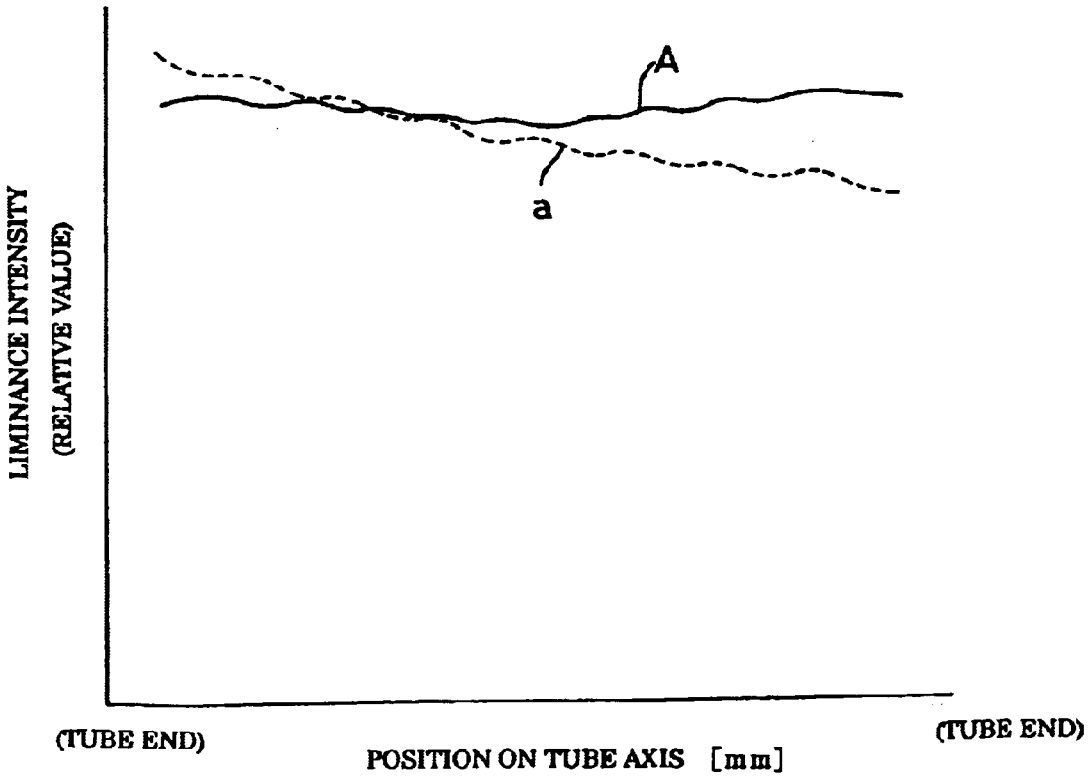
FIG. 7 is a graph showing a luminance intensity distribution in an axial direction of the fluorescent lamp shown in FIG. 6 by comparing with that of the fluorescent lamp shown in FIG. 1.

Curve A in FIG. 7 shows the distribution of luminance intensity (relative value) in the axial direction of the tube while the fluorescent lamp is turned on. It is confirmed that the almost uniform luminous intensity is presented over the entire length of the fluorescent lamp. For a comparison purpose, the similar measuring result is shown by the curve a obtained with the fluorescent lamp in the first embodiment, in which the outer electrode having the winding with the uniform pitch as shown in FIG. 1 is used.

Although, in the second embodiment, the winding pitch of the outer electrode 26 was decreased continuously according to the distance from the inner electrode 15 along the axis of the glass tube, the pitch is not necessarily changed continuous but may be changed in stepwise. Here, the stepwise change of the winding pitch is obtained with such various means described below. That is, the portion of the outer surface of the glass tube around which the conductor is wound is divided into more than 2 sections with respect to the axial direction of the glass tube, wherein (a) a conductor is wound at a uniform pitch for each section and the winding pitch in each section changes gradually as the section is away from the inner electrode;

(b) the winding pitch in each section changes continuously within a range which is defined by an upper and a lower limit at both ends of each section and a mean winding pitch per unit length in each section changes optionally with respect to a distance from the inner electrode;

(c) the winding pitch in each section is kept constant or changes gradualy and it changes rapidly at a boundary portion between an adjacent section; or (d) more than two of the above (a), (b) and (c) are combined.

Thus, an almost uniform or desired luminous intensity distribution characteristic is obtained along the tube axis when the winding pitch is made narrow as the section departs from the inner electrode 15.

Since the fluorescent lamp according to the first and second embodiments are of barrier discharge type through the wall of the glass tube with the required voltage applied between the outer and inner electrodes, a similar operation and results are recognized even in such a structure that an inner electrode is provided at both ends of the glass tube and voltage is applied between the outer and inner electrodes using more than one power source. Further, a similar operation and results are obtained even when the structures described are applied to a fluorescent lamp of an aperture structure, with a phosphor film formed on the inner surface of the glass tube partially removed in a strip shape along the axis of the tube.

Figure 8:
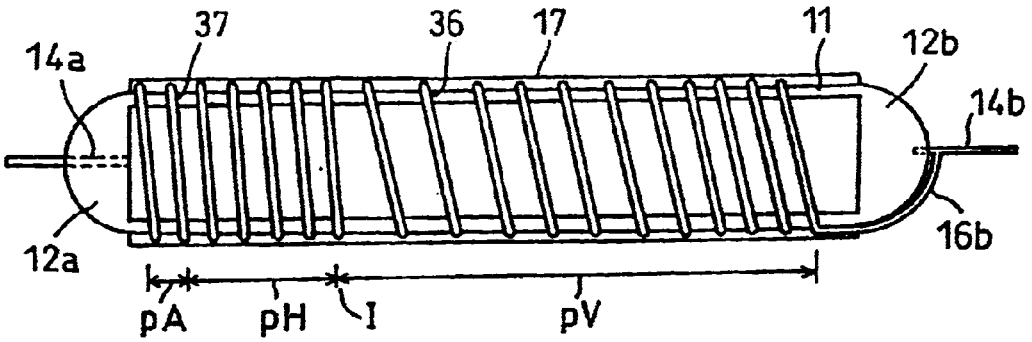
FIG. 8 is a side view showing the fluorescent lamp in a third embodiment according to the present invention.
Figure 9:
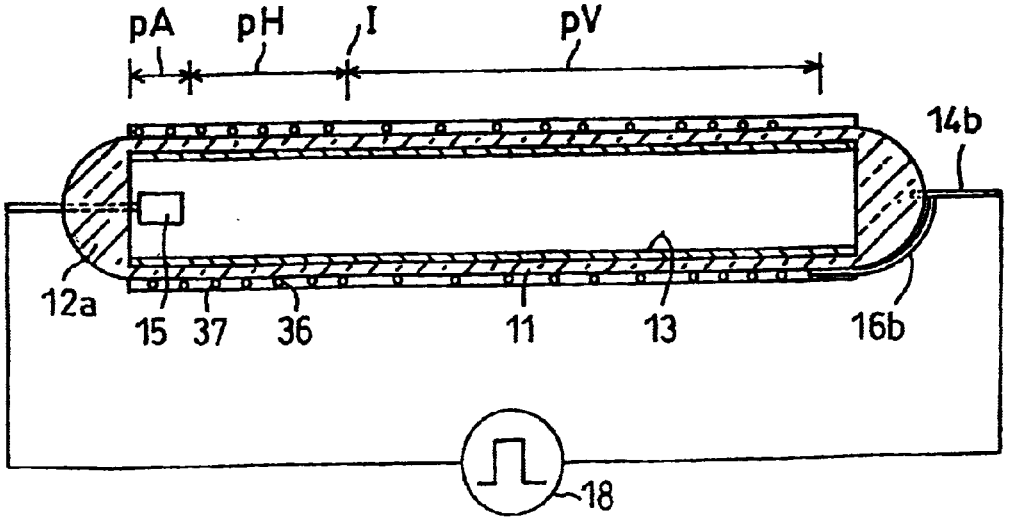
FIG. 9 is a vertical sectional view showing the fluorescent lamp in the third embodiment according to the present invention.

FIG. 8 is a side view of a fluorescent lamp showing a third embodiment according to the present invention and FIG. 9 is its vertical sectional view of the fluorescent lamp shown in FIG. 8. In the figures, the same or similar component elements as those of the fluorescent lamp shown in FIG. 1 are assigned with the same reference numerals therby avoiding the duplicated explanation and different elements from those in FIG. 1 will be described below.

In the fluorescent lamp according to the present embodiment, a winding pitch of an outer electrode 36 changes in three steps along the axis of the glass tube 11. That is, the winding pitch of the outer electrode 36 is small and becomes dense in a region starting from the end of the the glass tube 11 where the inner electrode 15 is provided to portion facing a constricted positive column PCs generated when the fluorescent lamp is turned on. The winding pitch in a region pV facing a diffused positive column PCd appeared adjacent to the constricted positive columns PCs is large and coarse at the end of the the glass tube 11 where the inner electrode 15 is provided but changes in such manner that it decreases in stepwise according to a distance from the inner electrode 15. As a result, a point of inflection I is formed at the boundary between the region pH facing the constricted positive column PCs and the region pV facing the diffused positive column PCd.

Further, a region pA is a region starting from the end of the the glass tube 11 where the inner electrode 15 is provided to a portion facing the inner electrode 15, wherein the winding pitch of the outer electrode 36 is as small as that in the region pH.

Figure 10:
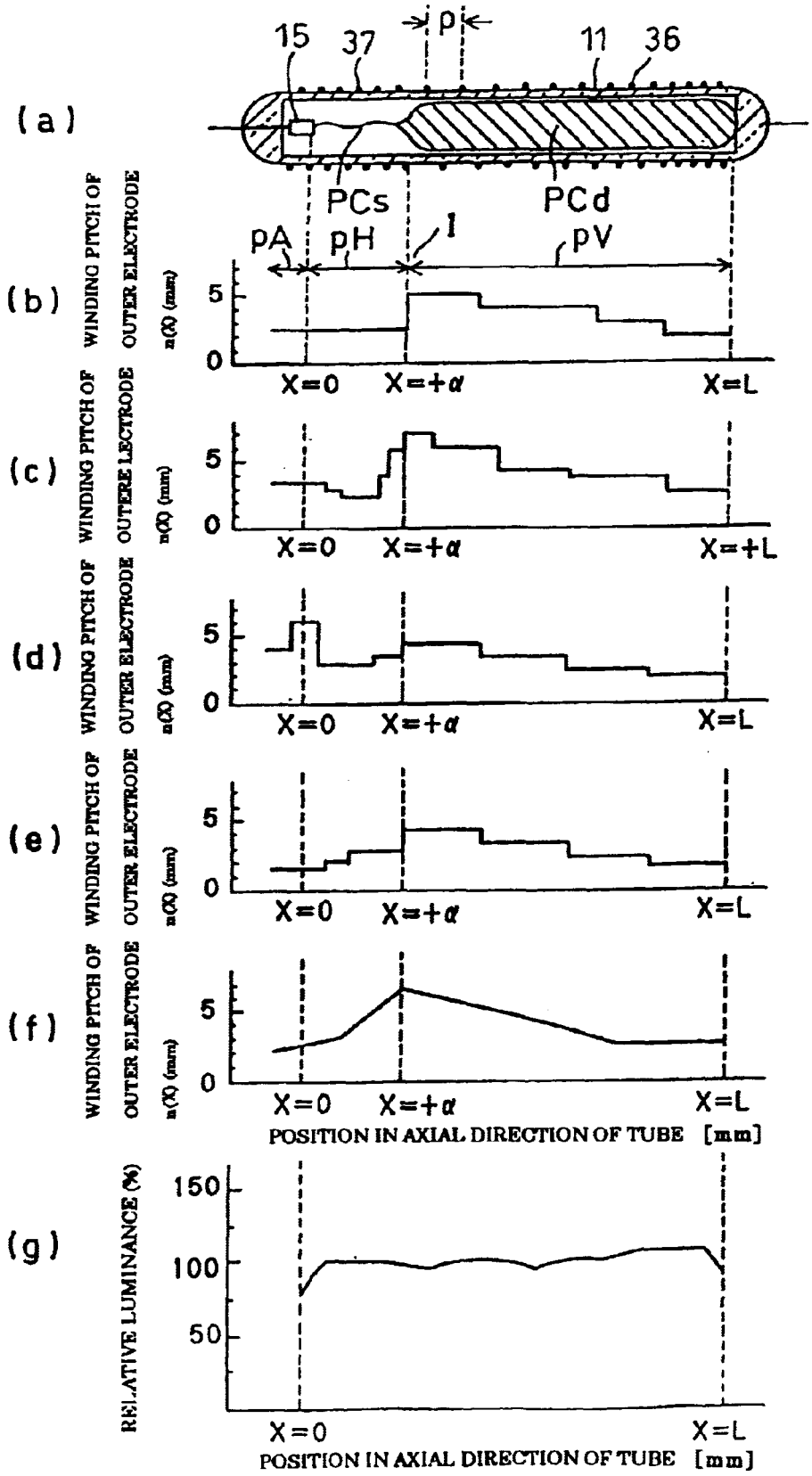
FIG. 10 is a sectional diagram showing a constricted positive column and a diffused positive column generated when the fluorescent lamp according to the present invention described is turned on and a graph showing a distribution of winding pitches and luminance in a longitudinal direction of a discharge lamp.

FIG. 10 is a sectional view of a fluorescent lamp according to the present invention showing the constricted positive column and the diffused positive column generated at the time when the fluorescent lamp is turned on with graphs showing distributions of winding pitches of the outer electrode and of luminance in the longitudinal direction of a discharge lamp. That is, (a) is a sectional view showing an operating state of the fluorescent lamp. FIGS. 10 (b)–(f) are graphs showing examples of winding pitch distribution of the outer electrode. FIG. 10(*g*) is a graph showing the luminance distribution in the axial direction of the fluorescent lamp.

In FIGS. 10(b)–(f), a x-axis shows a position x(mm) in the axial direction of the lamp tube and a y-axis shows a winding pitch n(X)(mm) of the outer electrode.

The example shown in FIG. 10(*b*) shows the winding pitch in the third embodiment shown in FIG. 9 and FIG. 10. That is, the winding pitch in the region pH facing the constricted positive column PCs is smaller than the winding pitch in the region pv facing the diffused positive column PCd. Hereinafter, this portion of the outer electrode 36 is called as a tube power increasing means 37. In the region pV facing the diffused positive column PCd, the winding pitch in the portion adjacent to the region pH is larger and coaser than that in the region pH but it becomes smaller in four steps according to a distance a parting from the inner electrode 15. Further, the winding pitch in the region pA facing the inner electrode 15 is the same as that in the region pH.

The example of the winding pitch shown in FIG. 10(*c*) is small as a whole in the region pH and provides the tube power increasing means 37. However, the winding pitch at the end adjacent to the region pA is slightly larger than that in the region pA and is increasing stepwisely toward an end adjacent to the region pV side, thereby being connected to the maximum point of the region pv which forms the point of inflection I. Further, the winding pitch in the region pv facing the diffused positive column PCd also varies similar to that shown in FIG. 10(*b*) except that it varies in 5 steps differing from that in (*b*).

In the example of the winding pitch shown in FIG. 10(*d*), the winding pitch at the end of the region pH close to the inner electrode 15 is large. It varies, however, from a small value to a large value stepwisely at the remaining portion of the region pH which forms the tube power increasing means 37. It is then connected to a maximum point in a portion adjacent to the region pH. In the region pA facing the inner electrode 15*d,* the winding pitch is the same as that at the end of the region pH. This is because the luminance is scarcely changed by the winding pitch of the outer electrode 36 in the region close to the inner electrode 15 even in the region pH as in the region pA. Therefore, it is possible to make the winding pitch large.

In the example of the winding pitch shown in FIG. 10(*e*), the region pH provides the tube power increasing means 37 as a whole. In the region pH, the winding pitch is minimum at the end close to the inner electrode 15 and reaches a maximum point at the end close to the region pV. It connects to the region pH while varying from the minimum value to the maximum value stepwisely and forms the point of inflection I at the end close to the region pV. The winding pitch in the region pA is the same as that of the end adjacent to the region pH.

The example of the winding pitch shown in FIG. 10(*f*) is similar to that shown in FIG. 10(*e*) as a whole but differs in that the winding pitch varies continuously.

The luminance distribution shown in FIG. 10(*g*) is obtained by the winding pitch example shown in FIG. 10(*b*). In this figure, a x-axis shows a position X(mm) in the axial direction of the lamp and a y-axis shows a relative luminance (%). From this diagram, it is seen that the luminance distribution is substantially uniform in the entire axial direction of the glass tube 11 ranging from the region pH facing the constricted positive column PCs to the region pv facing the diffused positive column PCd.

That is, in the fluorescent lamp, it was recognized that the constricted positive column is generated near the inner electrode 15 when the lamp is turned on as shown in FIG. 10(*a*) and that the luminance of the lamp at this portion drops lower than the portion wherein the diffused positive column is generated. However, according to the present invention, a substantially uniform luminance distribution with a high luminance was obtained by the tube power increasing means provided as described above.

According to the third embodiment of the present invention as described above, it is possible to increase the luminance of the portions where a disturbed diffused positive column or the constricted positive column is generated when the fluorescent lamp is turned on to substantially the same level as the level of the luminance in the adjacent diffused positive column by providing the lamp with the tube power increasing means 37 in which the winding pitch of the outer electrode 36 is made small at the above portions thereby increasing the tube power applied thereto. Accordingly, it is possible to obtain a fluorescent lamp which emits light stably by the uniform luminance distribution along the axial direction of the tube.

Figure 11:
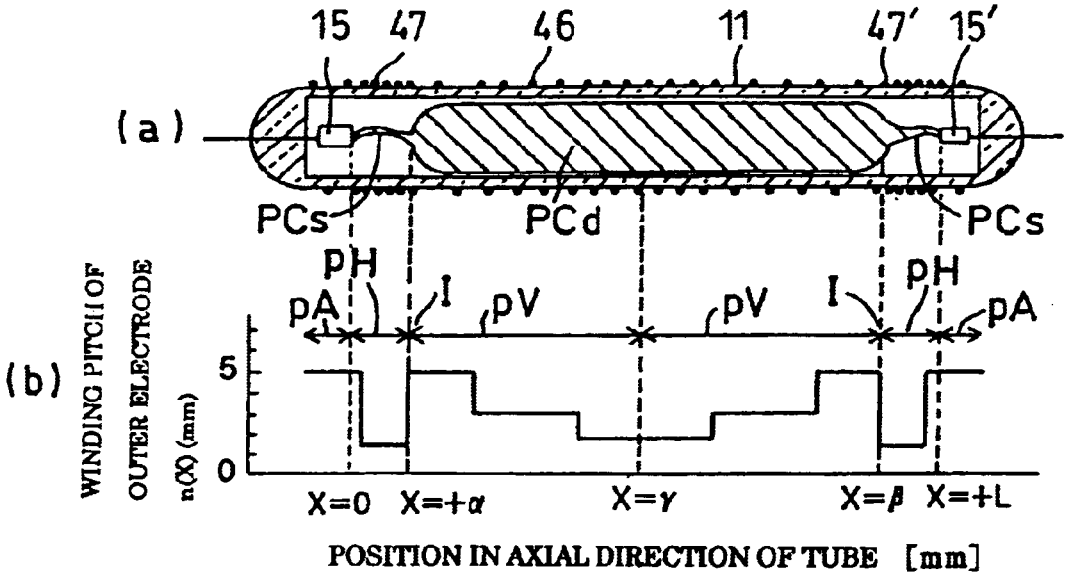
FIG. 11 is a diagram showing a fourth embodiment according to the present invention, wherein (a) in FIG. 11 is a vertical sectional view of the fluorescent lamp and (b) is a graph showing the distribution of the winding pitches of the outer electrode.

FIG. 11 is a diagram showing a fourth embodiment according to the present invention. In this figure, (a) is a vertical sectional view of the fluorescent lamp and (b) is a graph showing the distribution of the winding pitch of the outer electrode. In FIG. 11(*a*), the same or corresponding portions as those shown in FIG. 10(*a*) are assigned with the same reference numerals and the detailed explanations are omitted. Further, a x-axis and a y-axis in the graph shown in FIG. 11(*b*) are the same as those shown in FIGS. 10(*b*)–(*f*).

In this embodiment, a pair of inner electrodes 15, 15' are sealed at both ends of the glass tube 11. Further, a pair of constricted positive columns PCs are generated when the fluorescent lamp is turned on. The winding pitch of the outer electrode 46 in the region pH facing the constricted positive columns PCs in the vicinity of the both ends are made minimum, which formes a pair of tube power increasing means 47, 47'. The winding pitch is largest at both ends of the region pV facing the diffused positive column PCd which are close to the inner electrodes 15, 15' and in the region pA facing the inner electrodes 15, 15'. Then, the winding pitch decreases stepwisely from both ends to the central portion of the tube. Thus, in this embodiment, a pair of tube power increasing means 47, 47' are formed at both ends of the outer electrode.

In the fourth embodiment of the present invention described above, as in the third embodiment, whith the tube power increasing means 47, 47' being formed on the outer electrode 46 and the tube power applied to these portions being increased, a fluorescent lamp is obtained in which it is possible to raise the luminance of these portions to substantially the same level as the luminance of the diffused positive column portion which lies in the center portion of the tube and in which it is possible to emit light stably with the uniform luminance distribution along the axial direction of the tube.

Further, in the embodiment according to the present invention, power is supplied to the outer electrode 46 from the lighting power source (18 in FIG. 2 and FIG. 9) by connecting a feed line directly to the outer electrode 46. Likewise, in other embodiments than this embodiment, a feed line from the light power source may be connected directly to the outer electrode without connecting to the second feeding lead wire 14*b* one end of which is buried in the sealed portion 12*b* of the glass tube 11.

Figure 12:
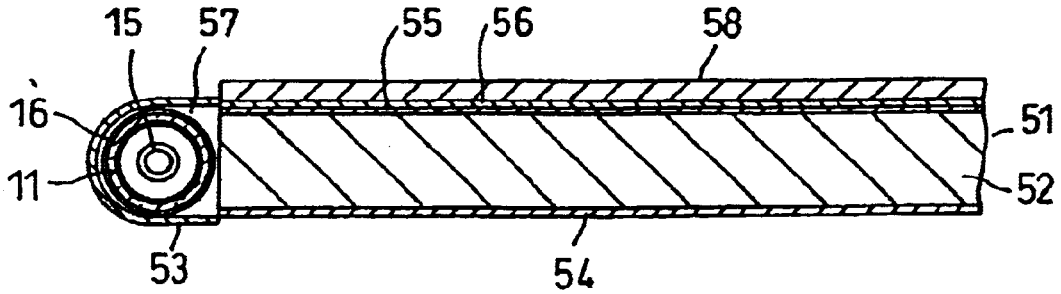
FIG. 12 is a sectional view of essential portions showing an embodiment according to the present invention applied to a liquid crystal display backlighting device.

FIG. 12 is a sectional view showing an essential part of a backlighting device for the liquid crystal display of other embodiment according to the present invention.

In FIG. 12, the same component elements as those shown in PIG. 1 are assigned with the same reference numerals and the detailed explanations are omitted. A backlighting device 51 is composed of a light conductor 52, a trough-shaped reflector 53, a back reflector 54, a diffusing plate 55 and a condensing plate 56 which are housed in a case (not shown) as a whole. The trough-shaped reflector 53 is provided on the side of the backlighting device 51 and contains a fluorescent lamp 57 according to the present invention. An additional set of the trough-shaped reflector 53 and the fluorescent lamp 57 may be provided at the opposite side of the backlighting device 51. A liquid crystal display 58 is provided on a front panel of the backlighting device 51. This liquid crystal display 58 is illuminated from its back by the backlighting device 51 providing a light transmission type liquid crystal display.

The light conductor 52 of the backlighting device 51 is composed of a transparent body such as transparent acrylic resins having a high refractive index. The trough-shaped reflector 53 reflects the light radiated from the fluorescent lamp 57 leading it into the light conductor 52 and shades the light of the fluorescent lamp from leakage. The back reflector 54 reflects the light emitted from the back of the light conductor 52 and emits from the front panel of the light conductor 52. Further, the reflective index of the back reflector 54 can be partially controlled so that the light is transmitted as uniform as possible from the entire surface. The diffusion plate 55 is provided on the front panel of the light conductor 52 for diffusing the light emitted forward from the light conductor 52 and for distributing the luminance as uniform as possible. The condensing plate 56 condenses the light emitted from the diffusion plate 55 and increases incident efficiency to the liquid crystal display 56.

The fluorescent lamp 57 and a lighting circuit (not illustrated) have a same structure as those shown in FIG. 1, FIG. 6, FIG. 8 or FIG. 11.

The present invention has been described above in various embodiments. However, this invention is not restricted to the above-mentioned embodiments but can be modified variously within the scope of the invention described in the claims.

For example, in the above embodiments, the fluorescent lamp is described as being suitable for the liquid crystal display backlighting device. However, the fluorescent lamp of this invention is applicable not only to liquid crystal displays but also to copying machines and other uses.

Further, in the above embodiments, this invention is described regarding a fluorescent lamp but is applicable to various kinds of discharge lamps.

Further, in the above embodiments, a glass tube is used as an airtight container comprising a fluorescent lamp but, needless to say, it is possible to use transparent containers made of other materials including quartz.

Further, in the above embodiments, the outer electrode is formed with a thin conductor wound round a glass tube. However, the outer electrode may be formed using such a technology as the evaporation or spattering of a linear or striped conductor around a glass tube.

What is claimed is:

1. A fluorescent lamp comprising:

a glass tube both ends of which are sealed airtight and a discharge medium filled in the inside;

a fluorescent layer formed on the inner wall of the glass tube;

a first feeding lead wire penetrating one of the sealing portions of the glass tube airtight;

an inner electrode connected to an end of the feeding lead wire extended into the glass tube;

a second feeding lead wire composed of a linear conductor which is spirally wound around an outer surface of the glass tube along an axial direction of the glass tube and an end of which is electrically connected to the second feeding lead wire;

wherein the outer electrode is so designed that a winding pitch of the linear conductor becomes continuously or stepwisely smaller corresponding to a distance from the inner electrode in the axial direction of the glass tube.

2. The fluorescent lamp according to claim 1, wherein the outer electrode is so designed as to satisfy the formula:

$$w \times n \leqq 0.3$$

where w(cm) is a width of the conductor comprising the outer electrode and n(turns/cm) is the average number of turns of the conductor in the unit length in the axial direction of the glass tube.

3. A fluorescent lamp according to claim 1, wherein the discharge medium is composed of a xenon gas or a mixture of a xenon gas with another rare gas.

4. A fluorescent lamp according to claim 3, wherein the outer surface of the outer electrode is covered with a translucent resin film together with the glass tube, thereby fixing the outer electrode to the outer surface of the glass tube to form an integral part thereof.

5. A fluorescent lamp according to claim 4, wherein one end of the second feeding lead wire is buried in the other sealing portion of the glass tube and the other end of the second feeding lead wire is led out of the glass tube.

6. A fluorescent lamp according to claim 4, wherein a specific resistance of the linear conductor forming the outer electrode is $2\times10^{-4}$ Ωcm or less.

7. A fluorescent lamp comprising:

a slender and translucent tube with sealing portions formed at its both ends;

a phosphor film formed on an inner surface of the translucent tube;

a discharge medium containing rare gas filled in the translucent tube;

a first feeding lead wire penetrating one of the sealing portions of the translucent tube and sealed therein airtight;

an inner electrode provided at an end of the first feeding lead wire, and an outer electrode composed of a linear conductor which is spirally wound around the translucent tube for almost the entire length of the tube in its axial direction and an end of which is connected to the second feeding lead wire;

wherein the outer electrode is provided with a tube power increasing means at a portion where a disturbed diffused positive column or a constricted positive column is generated in the translucent tube when the fluorescent lamp is operated.

8. A discharge lamp according to claim 7, wherein the winding pitch of the spirally wound linear conductor at the tube power increasing means is small than a winding pitch at the portion facing an adjacent diffused positive column.

9. A discharge lamp according to claim 8, wherein the winding pitch of the linear conductor of the outer electrode at the portion facing the diffused positive column becomes smaller as it departs from the inner electrode.

10. A fluorescent lamp according to claim 9, wherein the discharge medium is composed of a xenon gas or a mixture of a xenon gas with another rare gas.

11. A fluorescent lamp according to claim 10, wherein the outer surface of the glass tube including the outer electrode is covered with translucent resin film layer, thereby fixing the outer electrode to the outer surface of the glass tube to form an integral part thereof.

12. A fluorescent lamp according to claim 11, wherein a specific resistance of the linear conductor forming the outer electrode is $2\times10^{-4}$ Ωcm or less.

13. A discharge lamp comprising:

a long and slender translucent airtight container;

a phosphor film formed on the inner surface of the translucent container;

a pair of inner electrodes sealed in the translucent container at both ends; a discharge medium primarily composed of rare gas filled in the translucent airtight container; and an outer electrode formed with a linear conductor coil which is wound around the outer surface of the translucent airtight container along a longitudinal direction of the translucent airtight container at a prescribed pitch and which generates the discharge between the outer electrode and the pair of inner electrodes;

wherein the winding pitch of the outer electrode becomes minimum in a region (pH) facing a pair of constricted positive columns (PCs) generated in the translucent airtight container when the fluorescent lamp is in operation, becomes maximum at both ends in a region (pV) facing a diffused positive column (PCd).

14. A discharge lamp comprising:

a translucent tube with a phosphor film formed on the inner surface and a discharge medium filled in the inside;

a first feeding lead wire penetrating one of the sealed portion of the translucent tube airtight;

an inner electrode connected to the end of the feeding lead wire extended in the translucent tube; and an outer electrode composed of a linear conductor spirally wound around the outer surface of the translucent tube along its axial direction and is electrically connected to a second feeding lead wire;

wherein the outer electrode is so designed that the winding pitch of the linear conductor becomes smaller continuously or stepwisely in the axial direction of the translucent tube according to a distance from the inner electrode.

15. The discharge lamp according to claim 14, wherein the outer electrode is so designed as to satisfy the formula:

$$w \times n \leqq 0.3$$

where w (cm) is the width of the linear conductor forming the outer electrode and n(times/cm) is the average number of turns of windings per unit length in the axial direction of the translucent tube.

16. A discharge lamp comprising:

a translucent tube having sealing portions formed at its both ends;

a discharge medium including rare gas filled in the translucent tube;

a first feeding lead wire sealed penetrating airtight one of the sealing portions of the translucent tube;

an inner electrode provided at an end of the first feeding lead wire; and an outer electrode composed of a linear conductor which is spirally wound around the translucent tube for almost its entire length in an axial direction of the tube and an end of which is connected to a second feeding lead wire;

wherein the outer electrode is provided with a tube power increasing means at a portion facing a disturbed diffused positive column or a constricted positive column generated in the translucent tube when the discharge lamp is in operation.

17. The discharge lamp according to claim 16, wherein the outer electrode is so designed as to satisfy the formula:

$$w \times n \leqq 0.3$$

where w (cm) is the width of the linear conductor forming the outer electrode and n(times/cm) is the average number of turns of windings per unit length in the axial direction of the translucent tube.

18. A liquid crystal display backlighting device comprising:

a main body;

a lamp according to any one of the proceeding claims provided to the main body; and a lighting circuit to turn on the lamp.

* * * * *